US006382452B1

(12) United States Patent
Getachew et al.

(10) Patent No.: US 6,382,452 B1
(45) Date of Patent: May 7, 2002

(54) SEPARABLE CONTAINER APPARATUS

(76) Inventors: Nebiat T. Getachew, 1358 Portmuth Ct.; Leon Kahssai; Senait Getachew, both of 258 E. St. Charles Rd., #2C, all of Carol Stream, IL (US) 60188

( * ) Notice: Subject to any disclaimer, the term of this patent is extended or adjusted under 35 U.S.C. 154(b) by 0 days.

(21) Appl. No.: 09/641,852

(22) Filed: Aug. 18, 2000

(51) Int. Cl.[7] ..... B65D 1/24; B65D 57/00
(52) U.S. Cl. ..... 220/524; 220/523; 220/23.4
(58) Field of Search ..... 220/23.4, 523, 220/524, 23.83, 23.86

(56) References Cited

U.S. PATENT DOCUMENTS

| | | | | | |
|---|---|---|---|---|---|
| D208,806 | S | | 10/1967 | Bliss | |
| 3,506,321 | A | * | 4/1970 | Hampel | 220/23.4 |
| 4,139,114 | A | | 2/1979 | Long et al. | |
| 4,194,619 | A | * | 3/1980 | Schley | 220/23.4 |
| 4,821,903 | A | * | 4/1989 | Hayes | 220/23.4 |
| 4,834,253 | A | | 5/1989 | Crine | |
| 4,866,234 | A | | 9/1989 | Keefer | |
| 5,101,997 | A | | 4/1992 | Bagwell et al. | |
| 5,111,958 | A | * | 5/1992 | Witthoeft | 220/524 |
| 5,392,916 | A | * | 2/1995 | Paulison | 220/524 |
| 5,662,235 | A | * | 9/1997 | Nieto | 220/524 |
| 5,692,626 | A | * | 12/1997 | Wehrle et al. | 220/524 |
| 5,735,422 | A | | 4/1998 | Binter | |
| 5,992,677 | A | * | 11/1999 | Ebine | 220/524 |
| 6,189,722 | B1 | * | 2/2001 | Ason | 220/526 |
| 6,196,412 | B1 | * | 3/2001 | Cattell | 220/524 |

* cited by examiner

*Primary Examiner*—Joseph M. Moy

(57) ABSTRACT

A separable container apparatus for providing a convenient means of storing food products. The separable container apparatus includes containers each having an open top, a bottom wall, and a peripheral side wall assembly securely and integrally attached to and extending upwardly from the bottom wall with the containers being detachably connected to one another to essentially form a single structure having a plurality of storage compartments; and also includes lids being removably attached to any combination of attached containers.

11 Claims, 6 Drawing Sheets

SEPARABLE CONTAINER APPARATUS

BACKGROUND OF THE INVENTION

1. Field of the Invention

The present invention relates to a separably-attached containers and more particularly pertains to a new separable container apparatus for providing a convenient means of storing food products.

2. Description of the Prior Art

The use of a separably-attached containers is known in the prior art. More specifically, a separably-attached containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 208,806; U.S. Pat. No. 4,834,253; U.S. Pat. No. 4,866,234; U.S. Pat. No. 5,101,997; U.S. Pat. No. 5,735,422; and U.S. Pat. No. 4,139,114.

While these devices fulfill their respective, particular objectives and requirements, the aforementioned patents do not disclose a new separable container apparatus. The inventive device includes containers each having an open top, a bottom wall, and a peripheral side wall assembly securely and integrally attached to and extending upwardly from the bottom wall with the containers being detachably connected to one another to essentially form a single structure having a plurality of storage compartments; and also includes lids being removably attached to any combination of attached containers.

In these respects, the separable container apparatus according to the present invention substantially departs from the conventional concepts and designs of the prior art, and in so doing provides an apparatus primarily developed for the purpose of providing a convenient means of storing food products.

SUMMARY OF THE INVENTION

In view of the foregoing disadvantages inherent in the known types of separably-attached containers now present in the prior art, the present invention provides a new separable container apparatus construction wherein the same can be utilized for providing a convenient means of storing food products.

The general purpose of the present invention, which will be described subsequently in greater detail, is to provide a new separable container apparatus which has many of the advantages of the separably-attached containers mentioned heretofore and many novel features that result in a new separable container apparatus which is not anticipated, rendered obvious, suggested, or even implied by any of the prior art separably-attached containers, either alone or in any combination thereof.

To attain this, the present invention generally comprises containers each having an open top, a bottom wall, and a peripheral side wall assembly securely and integrally attached to and extending upwardly from the bottom wall with the containers being detachably connected to one another to essentially form a single structure having a plurality of storage compartments; and also includes lids being removably attached to any combination of attached containers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new separable container apparatus which has many of the advantages of the separably-attached containers mentioned heretofore and many novel features that result in a new separable container apparatus which is not anticipated, rendered obvious, suggested, or even implied by any of the prior art separably-attached containers, either alone or in any combination thereof.

It is another object of the present invention to provide a new separable container apparatus which may be easily and efficiently manufactured and marketed.

It is a further object of the present invention to provide a new separable container apparatus which is of a durable and reliable construction.

An even further object of the present invention is to provide a new separable container apparatus which is susceptible of a low cost of manufacture with regard to both materials and labor, and which accordingly is then susceptible of low prices of sale to the consuming public, thereby making such separable container apparatus economically available to the buying public.

Still yet another object of the present invention is to provide a new separable container apparatus which provides in the apparatuses and methods of the prior art some of the advantages thereof, while simultaneously overcoming some of the disadvantages normally associated therewith.

Still another object of the present invention is to provide a new separable container apparatus for providing a convenient means of storing food products.

Yet another object of the present invention is to provide a new separable container apparatus which includes containers each having an open top, a bottom wall, and a peripheral side wall assembly securely and integrally attached to and extending upwardly from the bottom wall with the containers being detachably connected to one another to essentially form a single structure having a plurality of storage compartments; and also includes lids being removably attached to any combination of attached containers.

Still yet another object of the present invention is to provide a new separable container apparatus that allows the user to compactly store food products in a single structure with the structure being separable into individual containers.

Even still another object of the present invention is to provide a new separable container apparatus that is easy and convenient to attach the containers together to form a single cylindrical structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
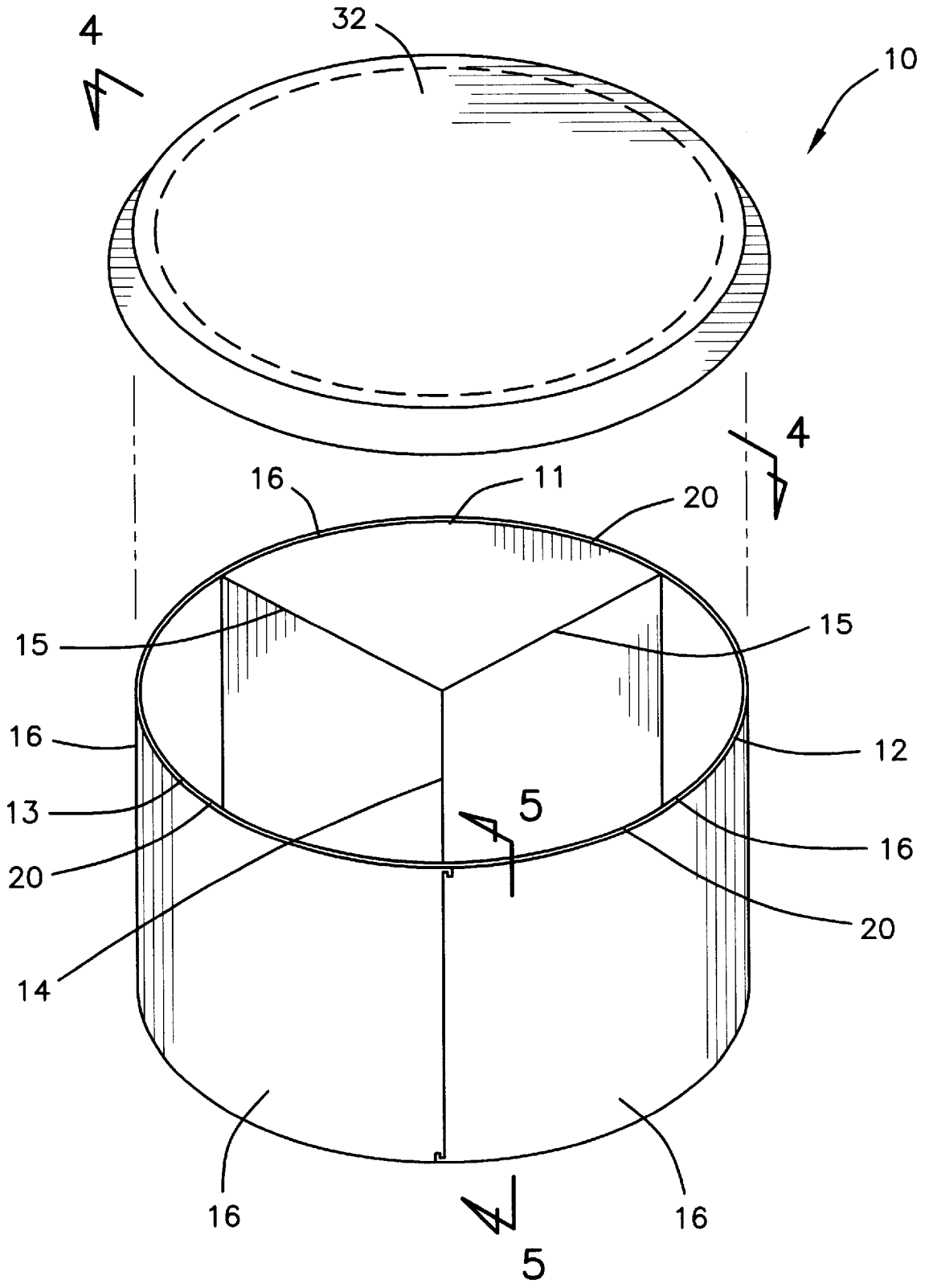
FIG. 1 is a perspective view of a new separable container apparatus according to the present invention.
Figure 2:
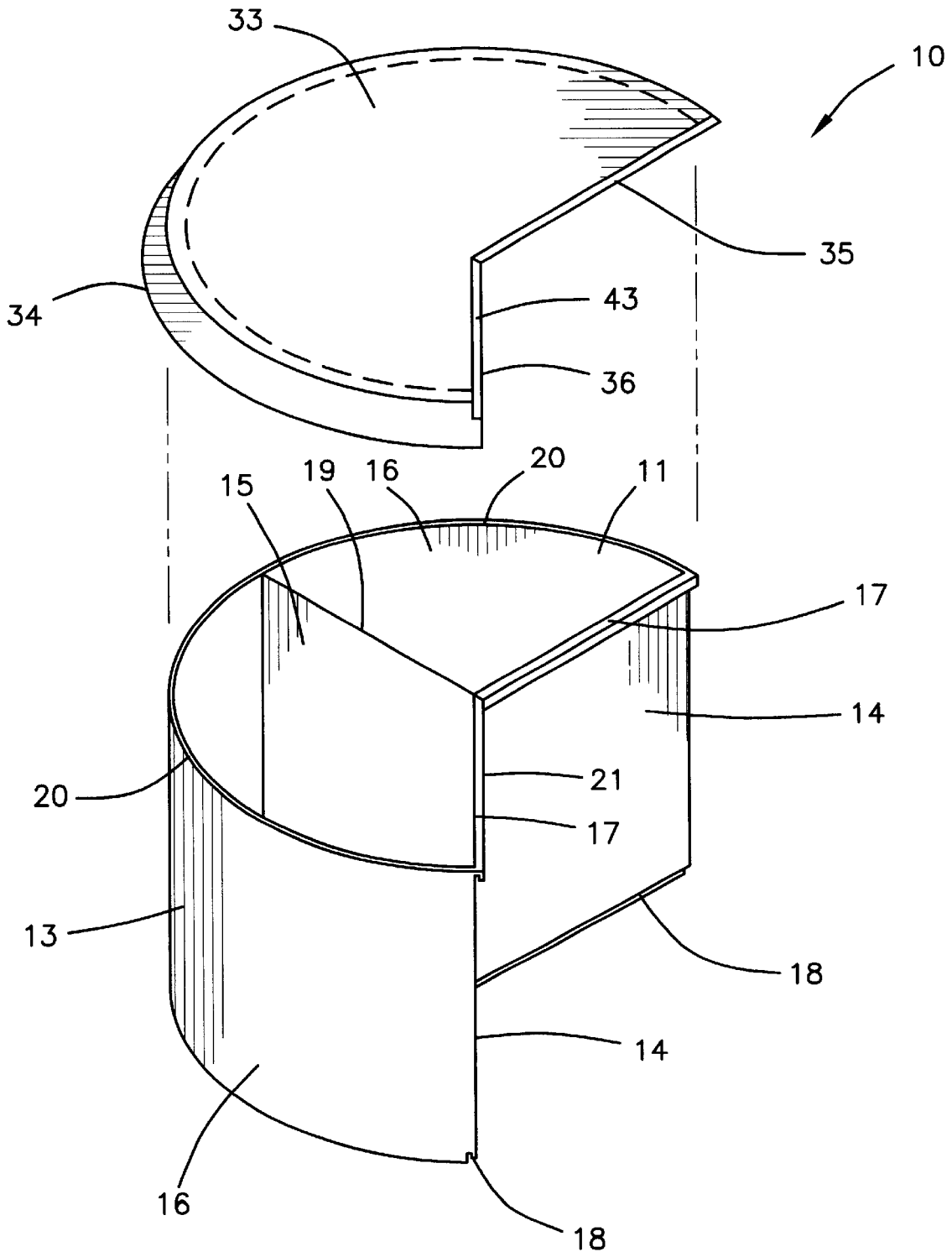
FIG. 2 is a perspective view of a second embodiment of the present invention.
Figure 3:
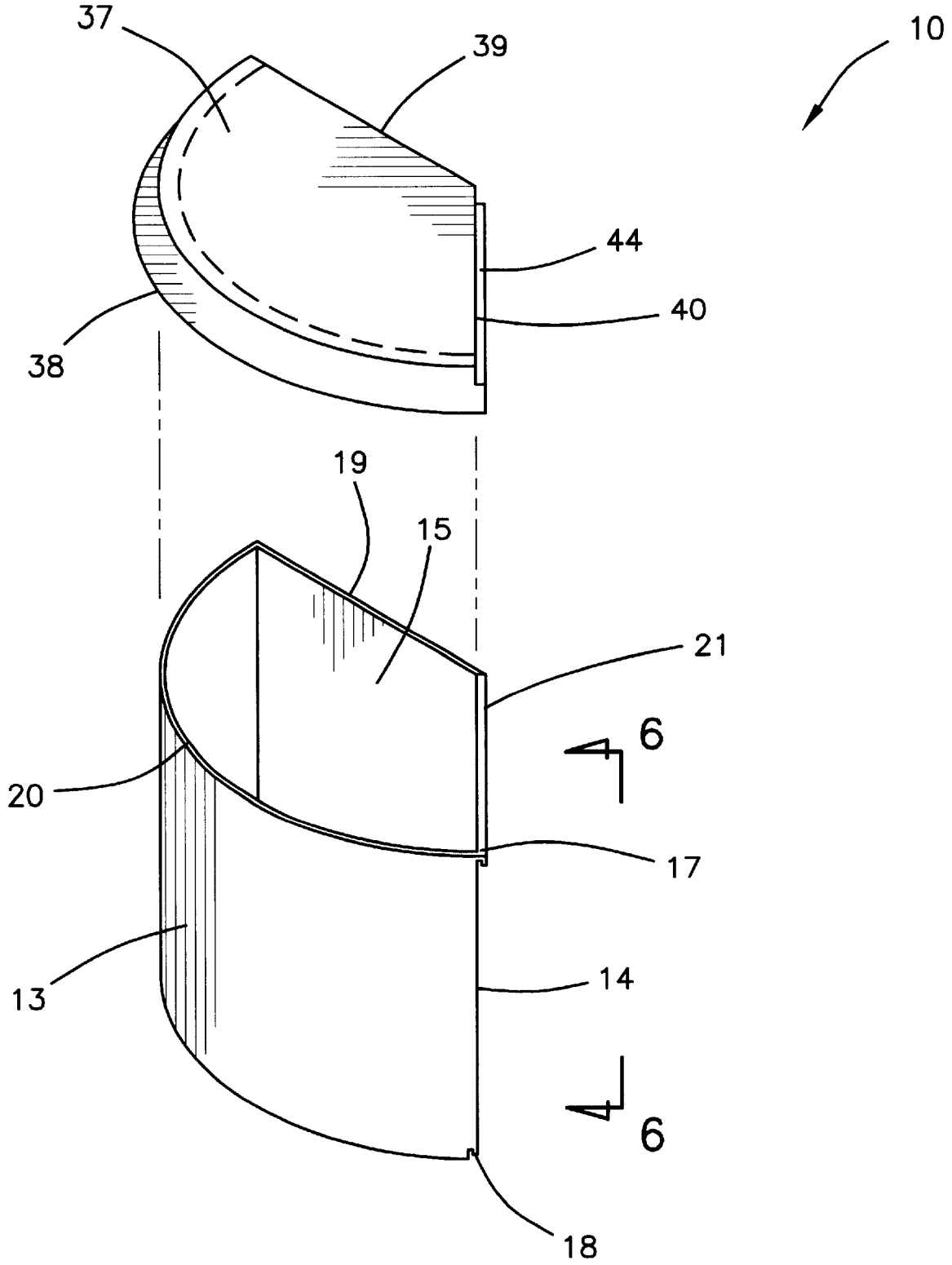
FIG. 3 is a perspective view of a third embodiment of the present invention.
Figure 4:
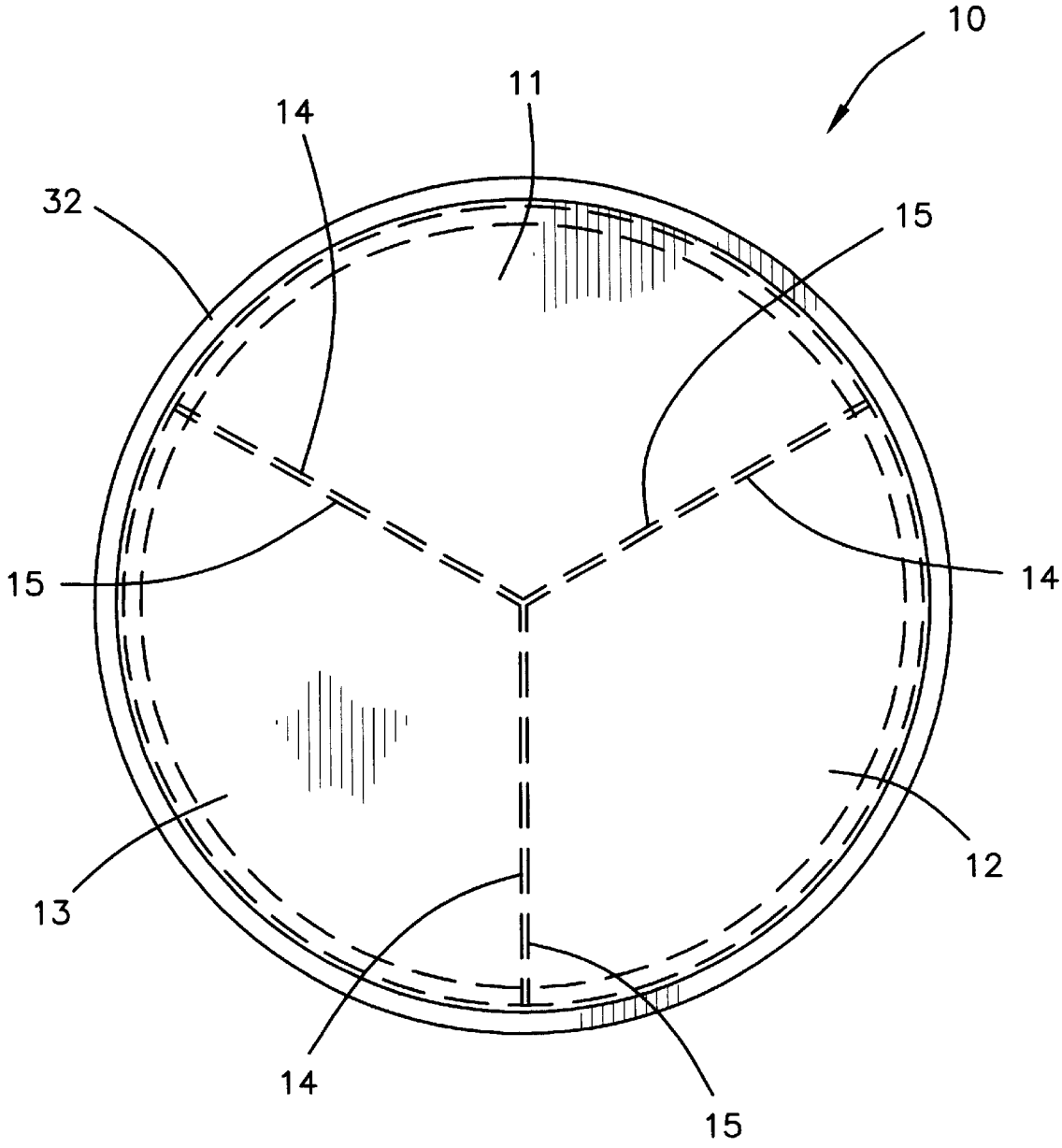
FIG. 4 is a top plan view of the first embodiment of the present invention.
Figure 6:
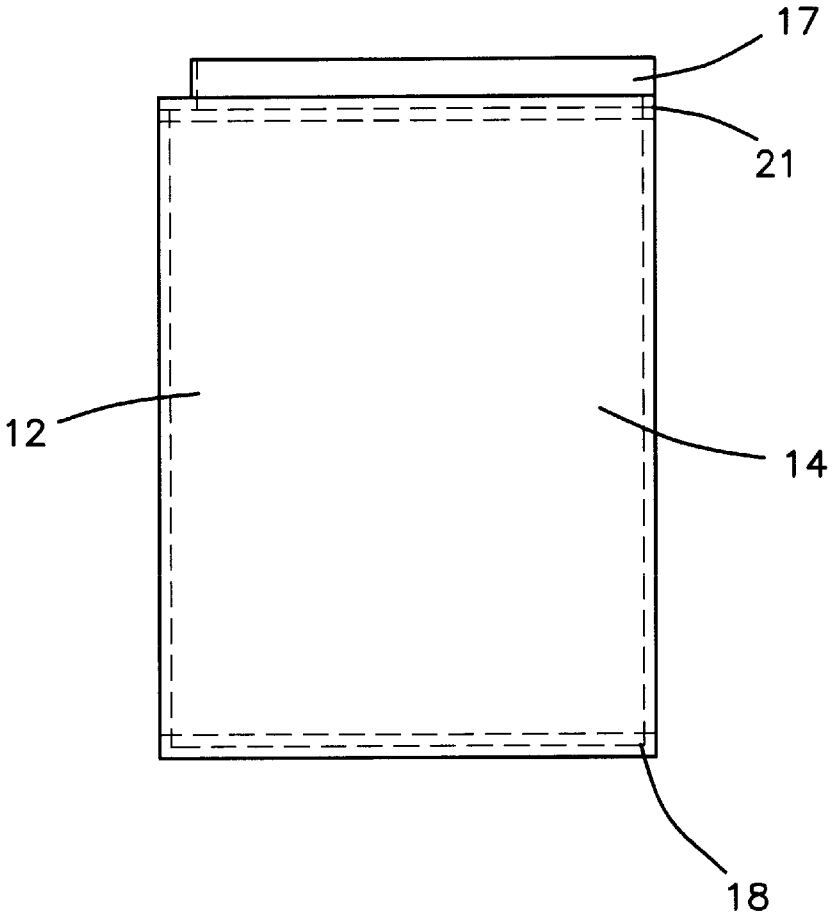
FIG. 6 is a side elevational view of the second embodiment of the present invention.
Figure 5:
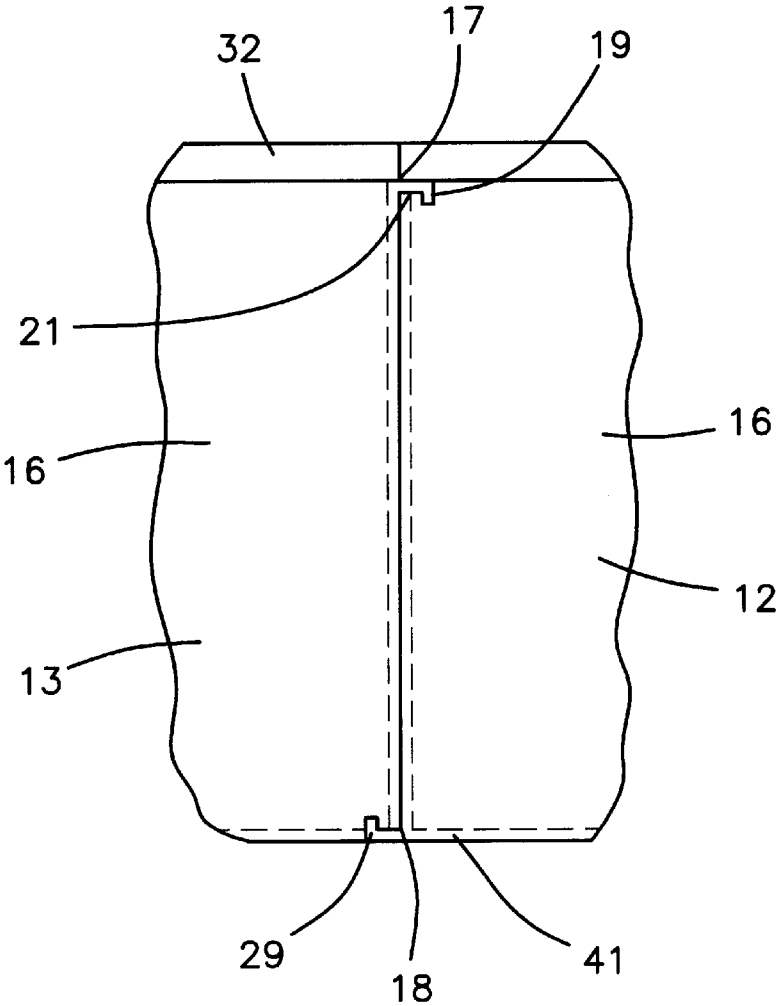
FIG. 5 is a side elevational view of the first embodiment of the present invention.
Figure 8:
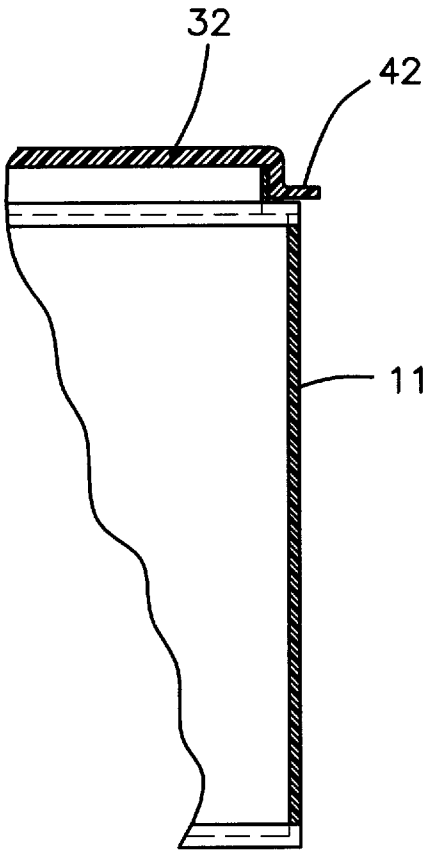
FIG. 8 is a cross-sectional view of the third embodiment of the present invention.
Figure 7:
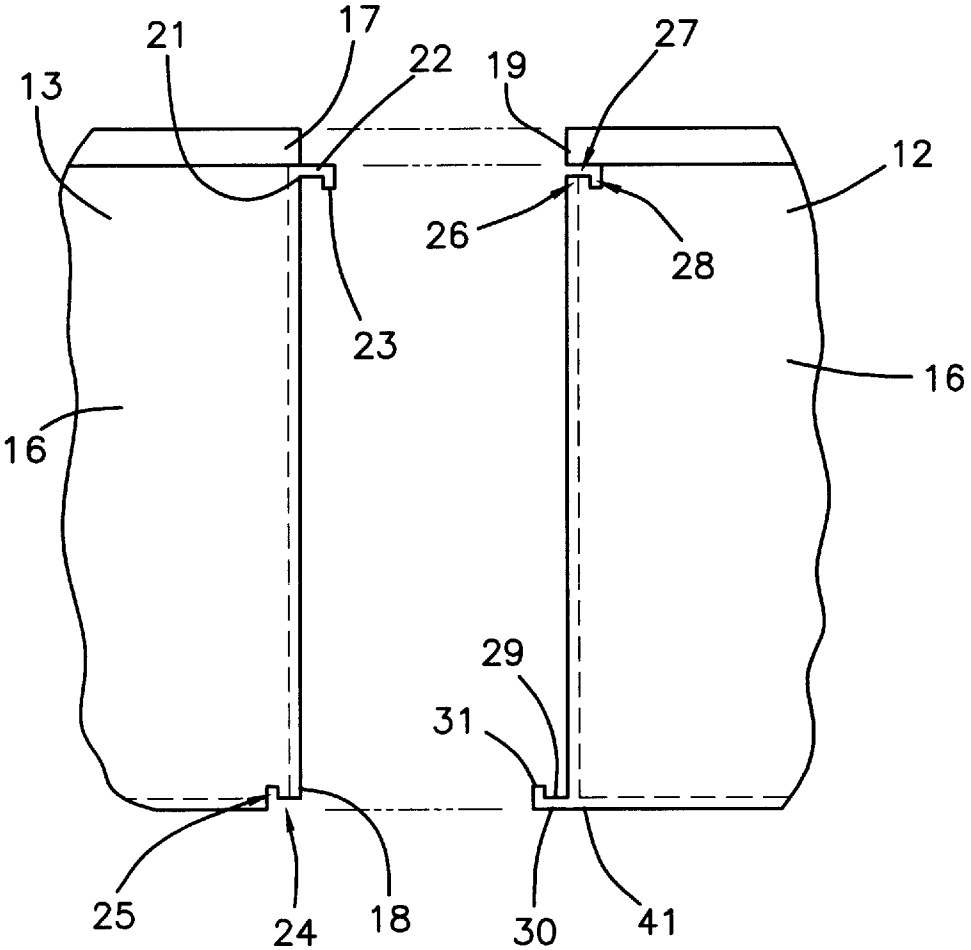
FIG. 7 is an exploded side elevational view of the first embodiment of the present invention.

With reference now to the drawings, and in particular to FIGS. 1 through 8 thereof, a new separable container apparatus embodying the principles and concepts of the present invention and generally designated by the reference numeral 10 will be described.

As best illustrated in FIGS. 1 through 8, the separable container apparatus 10 generally comprises containers 11–13 each having an open top, a bottom wall, and a peripheral side wall assembly 14–16 securely and integrally attached to and extending upwardly from the bottom wall with the containers 11–13 being detachably connected to one another to essentially form a single structure having a plurality of storage compartments. The peripheral side wall assembly 14–16 of each container 11–13 includes a first side wall 14, a second side wall 15, and a third side wall 16. Each of the first and second side walls 14,15 has a top edge 17,19 and a bottom edge 18,41 with the first and second side walls 14,15 of one of the containers 11–13 being detachably attached to the first and second side walls 14,15 of the others of the containers 11–13. The first side wall 14 of one container 11–13 is detachably attached to the second side wall 15 of another container 11–13. Each of the containers 11–13 includes an elongate first flange member 21 securely and conventionally attached to an exterior of the first side wall 14 and extending along a length of the top edge 17 thereof, and also includes a first recessed portion 24 disposed in the first side wall 14 and extending along a length of the bottom edge 18 thereof, and further includes a first slot 25 disposed in the first recessed portion 24 and extending the length of the bottom edge 18. Each elongate first flange member 21 includes a first portion 22 extending outwardly generally perpendicular of a respective first side wall 14, and also includes a second portion 23 being integrally attached to the first portion 22 and being angled relative to the first portion 22 and being disposed downwardly. Each of the containers 11–13 further includes a second slot 26 disposed in an exterior of the second wall 15 and extending along a length of the top edge 19 thereof and being adapted to receive the first flange member 21 of another container 11–13, and also includes an elongate second flange member 29 being securely and conventionally attached to an exterior of the second side wall 15 and extending outwardly and along a length of the bottom edge 41 thereof and being adapted to be received in the first recessed portion 24 and the first slot 25 of another container 11–13. Each of the second slots 26 is essentially angled and has a first portion 27 which extends into the second wall 14 and also has a second portion 28 which is angled relative to the first portion 27 and which is continuous of the first portion 27 and which is disposed downwardly. Each second flange member 29 includes a first portion 30 extending outwardly generally perpendicular of a respective second side wall 15, and also includes a second portion 31 being integrally attached to the first portion 30 and being angled relative to the first portion 30 and being disposed upwardly.

Lids 32,33,37 are removably attached to any combination of attached containers 11–13. The lids 32,33,37 include a first lid 32 which is adapted to detachably fastened to all of the containers 11–13 being attached to one another, and also includes a second lid 33 which is adapted to detachably fasten to two of the containers 11–13 being attached to one another, and further includes a third lid 37 which is adapted to detachably fasten to one of the containers 11–13. The containers 11–13 are detachably attached to one another to essentially form a cylindrical structure having multiple compartments therein with the first lid 32 being circular shaped and fastenable about top edges 20 of the third side walls 16 to close upon the open tops of the containers 11–13. Each of the containers 11–13 essentially represents ⅓ of the cylindrical structure with two of the containers 11–13 being detachably attached to one another to essentially form ⅔ of the cylindrical structure with the second lid 32 having a plurality of edges 34–36 and being adapted to fasten about the top edges 20 of the third side walls 16 of the two containers 11–13 and about the top edge 17 of the first side wall 14 of one of the containers 11–13 and about the top edge 19 of the second side wall 15 of the other container 11–13. The edges of the second lid 33 includes a curved first edge 34, a straight second edge 35, and a straight third edge 36 which is angled more than 90 degrees and less than 180 degrees relative to the second edge 35 thereof. The third lid 37 has a plurality of edges 38–40 and is adapted to fasten about the top edges 17,19,20 of the first, second, and third side walls 14–16 of one of the containers 11. The edges 38–40 of the third lid 37 include a curved first edge 38, a straight second edge 39, and a straight third edge 40 which is angled more than 180 degrees and less than 270 degrees relative to the second edge 39 thereof. The third side walls 16 are essentially curved, and the first and second side walls 14,15 are essentially planar. All the lids 32,33,37 further have lips 42–44 extending outwardly from one or more edges 34–36,38–40 thereof for opening and removing the lids 32,33,37 from the containers 11–13.

In use, the user attaches all three of the containers 11–13 together to form the cylindrical structure and places food products in each of the containers 11–13 and closes the containers 11–13 with the first lid 32 and stores the attached containers 11–13 in a cupboard or in the refrigerator or freezer. Alternatively, the user can separate the containers 11–13 as desired either as individual containers 11–13 or with two of the containers 11–13 being attached to one another.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A separable container apparatus comprising:

containers each having an open top, a bottom wall, and a peripheral side wall assembly securely attached to and extending upwardly from said bottom wall, said containers being detachably connected to one another to essentially form a single structure having a plurality of storage compartments; lids being removably attached to any combination of attached said containers; and said containers being detachably attached to one another to form a combined collective container structure having a cylindrical exterior shape;

wherein said peripheral side wall assembly of each said container includes a first side wall, a second side wall, and a third side wall, each of said first and second side walls having a top edge and a bottom edge;

wherein each of said containers includes an elongate first flange member securely attached to an exterior of said first side wall and extending along a length of said top edge thereof, and also includes a first recessed portion disposed in said first side wall and extending along a length of said bottom edge thereof, and further includes a first slot disposed in said first recessed portion and extending the length of said bottom edge.

2. A separable container apparatus as described in claim 1, wherein each said elongate first flange member includes a first portion extending outwardly generally perpendicular of a respective said first side wall, and also includes a second portion being integrally attached to said first portion and being angled relative to said first portion and being disposed downwardly.

3. A separable container apparatus comprising:

containers each having an open top, a bottom wall, and a peripheral side wall assembly securely attached to and extending upwardly from said bottom wall, said containers being detachably connected to one another to essentially form a single structure having a plurality of storage compartments; lids being removably attached to any combination of attached said containers; and said containers being detachably attached to one another to form a combined collective container structure having a cylindrical exterior shape;

wherein said peripheral side wall assembly of each said container includes a first side wall, a second side wall, and a third side wall, each of said first and second side walls having a top edge and a bottom edge;

wherein each of said containers further includes a second slot disposed in an exterior of said second wall and extending along a length of said top edge thereof and being adapted to receive said first flange member of another said container, and also includes an elongate second flange member being securely attached to an exterior of said second side wall and extending outwardly and along a length of said bottom edge thereof and being adapted to be received in said first recessed portion and said first slot of another said container.

4. A separable container apparatus as described in claim 3, wherein each of said second slots is essentially angled and has a first portion which extends into said second wall and also has a second portion which is angled relative to said first portion and which is continuous of said first portion and which is disposed downwardly.

5. A separable container apparatus as described in claim 4, wherein each said second flange member includes a first portion extending outwardly generally perpendicular of a respective said second side wall, and also includes a second portion being integrally attached to said first portion and being angled relative to said first portion and being disposed upwardly.

6. A separable container apparatus comprising:

containers each having an open top, a bottom wall, and a peripheral side wall assembly securely attached to and extending upwardly from said bottom wall, said containers being detachably connected to one another to essentially form a single structure having a plurality of storage compartments; lids being removably attached to any combination of attached said containers; and said containers being detachably attached to one another to form a combined collective container structure having a cylindrical exterior shape;

wherein said lids include a first lid which is adapted to detachably fasten to all of said containers being attached to one another, and also includes a second lid which is adapted to detachably fasten to two of said containers being attached to one another, and further includes a third lid which is adapted to detachably fasten to one of said containers.

7. A separable container apparatus as described in claim 6, wherein said first lid is circular shaped and fastenable about top edges of said third side walls to close upon said open tops of said containers.

8. A separable container apparatus as described in claim 6, wherein each of said containers essentially represents ⅓ of said cylindrical structure.

9. A separable container apparatus comprising:

containers each having an open top, a bottom wall, and a peripheral side wall assembly securely attached to and extending upwardly from said bottom wall, said containers being detachably connected to one another to essentially form a single structure having a plurality of storage compartments; lids being removably attached to any combination of attached said containers; and said containers being detachably attached to one another to form a combined collective container structure having a cylindrical exterior shape;

wherein two of said containers are detachably attached to one another to essentially form ⅔ of said cylindrical structure with said second lid having a plurality of edges and being adapted to fasten about said top edges of said third side walls of the two of said containers and about said top edge of said first side wall of one of said containers and about said top edge of said second side wall of the other of said containers, said edges of said second lid including a curved first edge, a straight second edge, and a straight third edge which is angled more than 90 degrees and less than 180 degrees relative to said second edge thereof.

10. A separable container apparatus comprising:

containers each having an open top, a bottom wall, and a peripheral side wall assembly securely attached to and extending upwardly from said bottom wall, said containers being detachably connected to one another to essentially form a single structure having a plurality of storage compartments; lids being removably attached to any combination of attached said containers; and said containers being detachably attached to one another to form a combined collective container structure having a cylindrical exterior shape;

wherein said peripheral side wall assembly of each said container includes a first side wall, a second side wall, and a third side wall, each of said first and second side walls having a top edge and a bottom edge;

wherein said third lid has a plurality of edges and is adapted to fasten about said top edges of said first, second, and third side walls of one of said containers, said edges of said third lid including a curved first edge, a straight second edge, and a straight third edge which is angled more than 180 degrees and less than 270 degrees relative to said second edge thereof.

11. A separable container apparatus as described in claim 10, wherein said third side walls are essentially curved, and said first and second side walls are essentially planar.

* * * * *